US007064635B2

(12) United States Patent
Bogdon et al.

(10) Patent No.: US 7,064,635 B2
(45) Date of Patent: Jun. 20, 2006

(54) CIRCUIT BREAKER INCLUDING ALARM INTERFACE LEVER

(75) Inventors: Erik Russell Bogdon, Carnegie, PA (US); Joseph Bell Humbert, Monaca, PA (US); Douglas Charles Marks, Murrysville, PA (US); Craig Allen Rodgers, Butler, PA (US); Dominic Patrick Martelli, McKees Rocks, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/226,801

(22) Filed: Sep. 14, 2005

(65) Prior Publication Data

US 2006/0071741 A1 Apr. 6, 2006

Related U.S. Application Data

(60) Provisional application No. 60/615,125, filed on Oct. 1, 2004.

(51) Int. Cl.
*H01H 73/12* (2006.01)

(52) U.S. Cl. ..... 335/6; 335/17

(58) Field of Classification Search ..... 335/6, 335/17

See application file for complete search history.

(56) References Cited

U.S. PATENT DOCUMENTS

| | | | | |
|---|---|---|---|---|
| 4,754,245 | A * | 6/1988 | Toda et al. | 335/17 |
| 6,140,897 | A | 10/2000 | Mueller et al. | |
| 6,600,396 | B1 * | 7/2003 | Rodriguez et al. | 335/132 |
| 6,633,210 | B1 | 10/2003 | Fischer et al. | |
| 6,747,534 | B1 | 6/2004 | Mueller et al. | |
| 6,778,048 | B1 * | 8/2004 | Brignoni et al. | 335/132 |
| 6,867,670 | B1 * | 3/2005 | McCormick et al. | 335/6 |
| 6,867,671 | B1 * | 3/2005 | Rodriguez et al. | 335/132 |
| 6,943,652 | B1 * | 9/2005 | Rodriguez et al. | 335/6 |

* cited by examiner

*Primary Examiner*—Ramon M. Barrera
(74) *Attorney, Agent, or Firm*—Martin J. Moran

(57) ABSTRACT

A circuit breaker including a housing, separable contacts, a cradle rotatably mounted within the housing, an alarm switch mounted within the housing, and an interface lever disposed between the cradle and the alarm switch. The cradle is adapted to rotate about a first axis in a first direction when the circuit breaker moves to a tripped position in which the separable contacts are separated from one another. The alarm switch includes an actuation lever movable in an actuation direction, wherein movement of the actuation lever in the actuation direction causes the alarm switch to activate an alarm device electrically connected thereto. When the cradle rotates in the first direction, the cradle exerts a first force against the interface lever that causes the interface lever to exert a second force against the actuation lever that causes the actuation lever to move in the actuation direction.

6 Claims, 8 Drawing Sheets

CIRCUIT BREAKER INCLUDING ALARM INTERFACE LEVER

CROSS-REFERENCE TO RELATED APPLICATION

This application claims the benefit of U.S. Provisional Application No. 60/615,125 entitled "Circuit Breaker Including Alarm Interface Lever," which was filed on Oct. 1, 2004.

BACKGROUND OF THE INVENTION

1. Field of the Invention

This invention pertains generally to circuit interrupters and, more particularly, to circuit breakers including an alarm switch for activating an alarm to indicate that the circuit breaker has moved to a tripped position.

2. Background Information

Circuit interrupters, such as circuit breakers, are employed in diverse capacities in power distribution systems. A circuit breaker may include, for example, a line conductor, a load conductor, a fixed contact and a movable contact, with the movable contact being movable into and out of electrically conductive engagement with the fixed contact to switch the circuit breaker between an on or closed position and an off or open position, or between the on or closed position and a tripped position. The fixed contact is electrically conductively engaged with one of the line and load conductors, and the movable contact is electrically conductively engaged with the other of the line and load conductors.

Circuit breakers may also include an operating mechanism having a movable contact arm upon which the movable contact is disposed, a pair of links, a main spring, a latch mechanism, a cradle and a movable operating handle that extends outside of a housing for the circuit breaker. The cradle is pivotally disposed between the latch mechanism and the links. One portion of the cradle pivots with respect to the housing while another portion of the cradle has a latch ledge, which is latched by the latch mechanism. It is known to employ latch mechanisms including a primary latch and a secondary latch. See, for example, U.S. Pat. Nos. 6,747,534 and 6,140,897.

Inasmuch as the electrical disengagement of the movable contact from the fixed contact results in an interruption of current through the circuit breaker, it is known in the art to provide one or more switches that are mechanically operated by the operating mechanism and that are operatively connected with alarm bells, warning lights, and other devices that are calculated to inform a technician that the circuit breaker is in an interrupted or off condition. Such switches are components in a switch assembly that is mountable within the circuit breaker and often include an alarm switch that is operatively connected with the cradle or handle of the operating mechanism to detect a tripped state of the circuit breaker. In such applications, the switch usually includes an actuation lever in the form of a plastic part, a tang of spring steel or some other material that is connected at an attachment end thereof with the switch housing and that protrudes outwardly therefrom. A component of the operating mechanism, such as the cradle, includes one or more eccentric camming surfaces which, upon rotation of the component, moves, e.g., rotates, the actuation lever of the switch. Movement of the actuation lever by the camming surface causes the actuation lever to activate a micro-switch within the switch housing that actuates the electrical contacts within the switch that operate the alarm devices connected therewith. Circuit breakers employing an alarm switches in this manner are described in, for example, U.S. Pat. No. 6,633,210.

There is room for improvement in circuit breakers employing alarm switches.

SUMMARY OF THE INVENTION

The present invention relates to a circuit breaker including a housing, separable contacts, a cradle rotatably mounted within the housing, an alarm switch mounted within the housing, and an interface lever disposed between the cradle and the alarm switch. The cradle is adapted to rotate about a first axis in a first direction when the circuit breaker moves to a tripped position in which the separable contacts are separated from one another. The alarm switch includes an actuation lever movable in an actuation direction, wherein movement of the actuation lever in the actuation direction causes the alarm switch to activate an alarm device electrically connected thereto. When the cradle rotates in the first direction, the cradle exerts a first force against the interface lever that causes the interface lever to exert a second force against the actuation lever that causes the actuation lever to move in the actuation direction.

In on embodiment, the cradle includes a protrusion extending therefrom. The interface lever in this embodiment is rotatably mounted within the housing, and has a cradle interface surface aligned with the protrusion. The interface lever also has an alarm actuation surface aligned with the actuation lever. The interface lever is adapted to rotate about a second axis in a second direction, wherein when the cradle rotates in the first direction, the protrusion exerts the first force against the cradle interface surface, thereby causing the interface lever to rotate in the second direction, and wherein when the interface lever rotates in the second direction, the alarm actuation surface exerts the second force against the actuation lever. The interface lever may have a generally U-shaped body, with the cradle interface surface being located at a first end of the generally U-shaped body and the alarm actuation surface being located at a second end of the generally U-shaped body. In addition, the circuit breaker housing may include an accessory pocket in which the interface lever and the alarm switch are mounted. The accessory pocket may have a recess that receives a pin extending from the interface lever, wherein the second axis is a central axis of the pin.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The present invention is described in association with a three-pole circuit breaker 10, although the invention is applicable to a wide range of circuit interrupters including one or more poles. Examples of circuit breakers are disclosed in U.S. Pat. Nos. 6,747,534 and 6,140,897, which are incorporated by reference herein.

Figure 1:
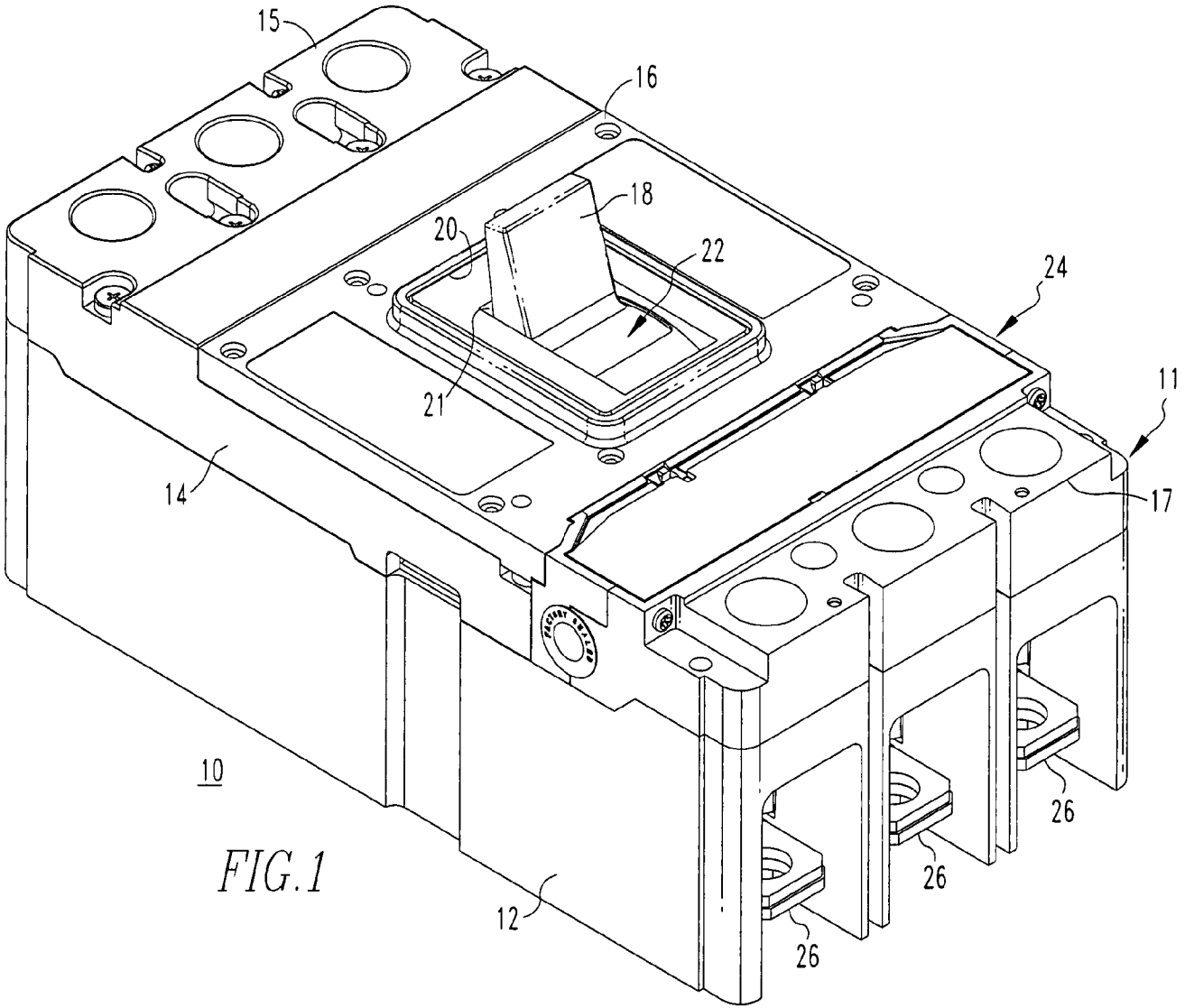
FIG. 1 is an isometric view of a circuit breaker in accordance with the present invention.
Figure 2:
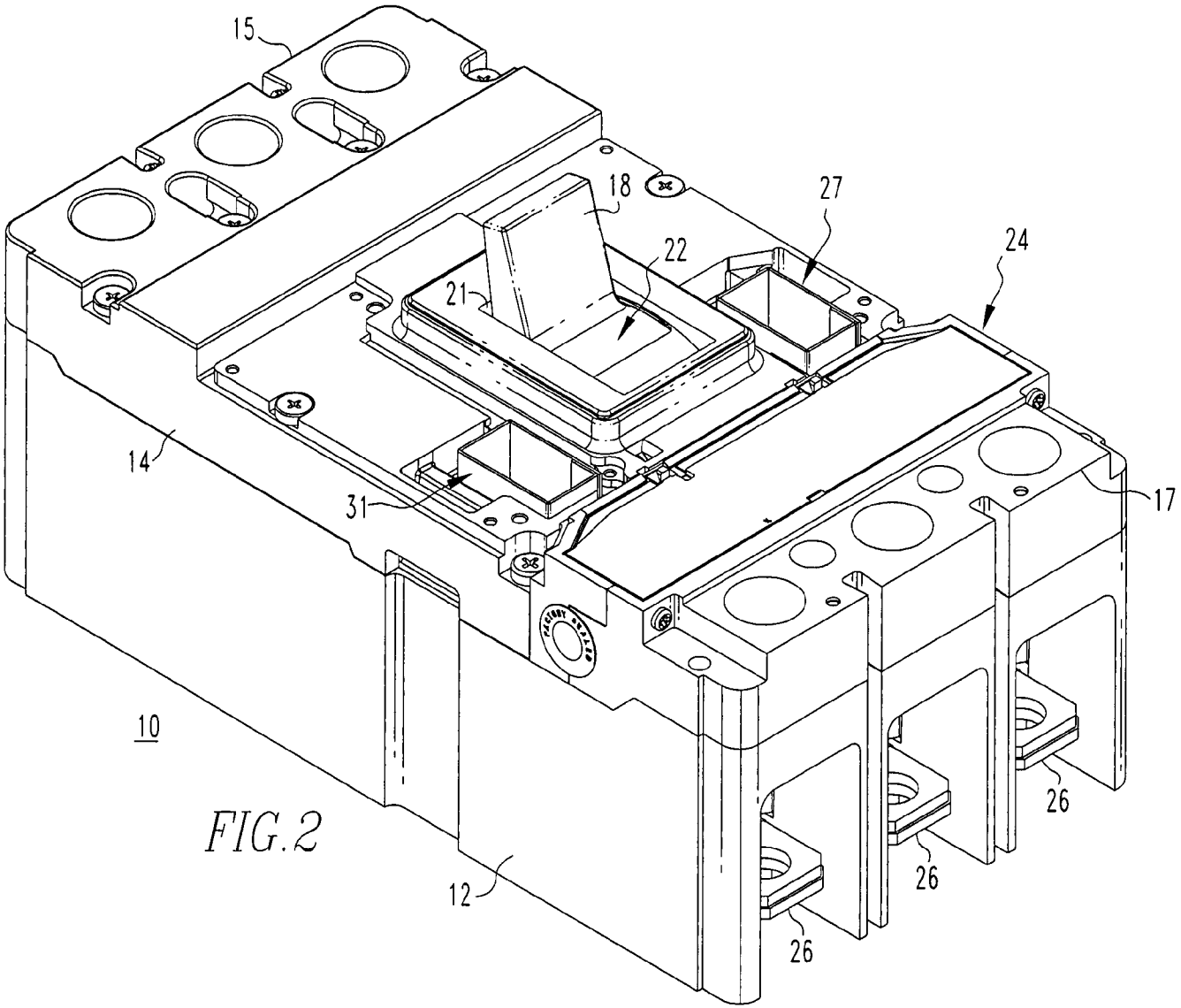
FIG. 2 is an isometric view of the circuit breaker of FIG. 1 with a secondary cover removed.

Referring to FIGS. 1 and 2, there is shown a molded case circuit breaker or interrupter 10 having a main base 12 and a primary cover 14. Attached to the primary cover 14 is a secondary cover 16 (as shown in FIG. 1; the secondary cover 16 is removed in FIG. 2). A handle 18 extends through a secondary escutcheon 20 in the secondary cover 16 and aligned primary escutcheon 21 in the primary cover 14. An operating mechanism 22 is interconnected with the handle 18 and is adapted to open and close separable main contacts 23 (FIG. 3) in a manner which will be described below. This circuit breaker 10 includes a line end 15, a load end 17 and a removable trip unit 24. There are also depicted load terminals 26, a right side accessory region or pocket 27 (FIG. 2) and a left side accessory pocket or region 31 (FIG. 2).

Figure 3:
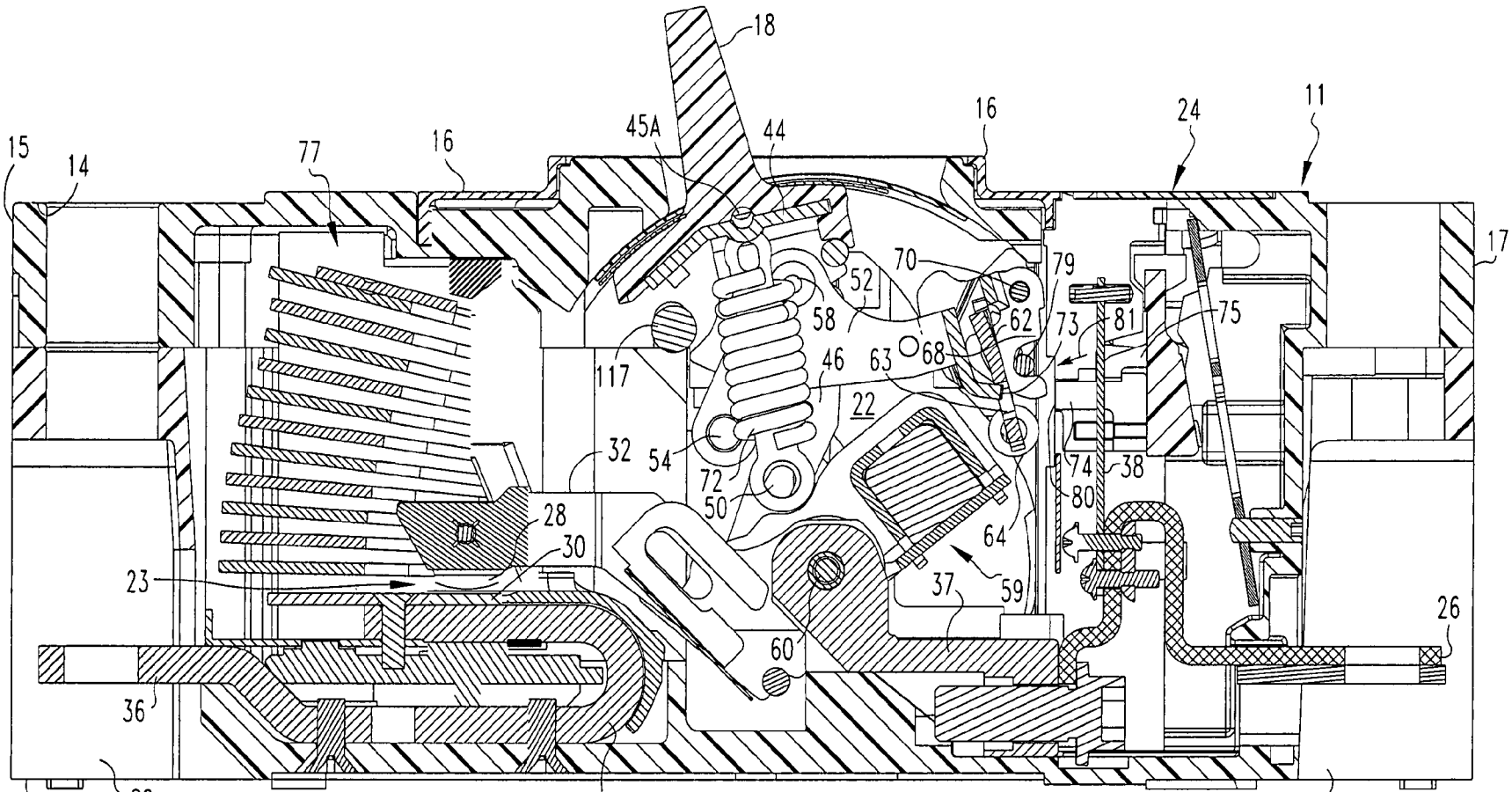
FIG. 3 is a cut away vertical elevation section of the circuit breaker of FIG. 1, depicting the separable contacts in the closed position.

Referring now more specifically to FIG. 3, there are depicted a separable movable contact 28 disposed upon a movable contact arm 32 and a fixed contact 30 disposed upon a fixed contact support or U-shaped member 34. Line terminal 36 is disposed to the left in FIG. 3, for example, at the line end 15 of the circuit breaker 10 in a terminal cave or pocket 29. The load terminal 26 is disposed to the right in FIG. 3, for example, in a load terminal cave or pocket 33. To the left on the line terminal 36 is disposed a line terminal collar (not shown), and to the right is provided a load terminal-contact arm conductor 37. The conductor 37 is electrically interconnected at its other end with a bi-metal heater 38, which, in turn, is electrically interconnected at its other end with the load terminal 26. Consequently, when the circuit breaker separable main contacts 28 and 30 are closed upon each other, there is a complete electrical circuit through the circuit breaker 10 from right to left starting with load terminal 26 through bi-metal heater 38, through conductor 37, through movable contact arm 32, through movable contact 28 to fixed contact 30, and from there through the fixed contact support or U-shaped member 34 to line terminal 36.

The operating mechanism 22 assists in opening and closing the separable main contacts 28 and 30. The trip unit 24 cooperates with the operating mechanism 22 to trip open such contacts 28,30. In particular, the operating mechanism 22 includes a cradle 52, which is pivoted on one end at a cradle fixed pivot pin 54 by way of an opening in the cradle 52 for placement of the cradle fixed pivot pin 54 therein. The cradle 52 includes a side protrusion 53 (FIG. 8), the purpose of which is described herein. There is provided an upper toggle link 46 and a lower toggle link (not shown). The links are joined pivotally by an upper and lower toggle link pin 50. There is provided a lower toggle link to cam carrier attachment pin (not shown), which is affixed to the cam carrier (not shown) at an opening therein (not shown). There is also a cradle to upper toggle link pivot pin (not shown), by which the upper toggle link 46 is placed in physical contact with the cradle 52. There is further provided a movable contact arm main pivot assembly 59, which movably, rotatably pivots on a pivot 60.

There is also provided a primary latch 62 which operates or pivots on a pivot 64. The primary latch 62 cooperates with a secondary latch 68, which pivots on a secondary latch pivot pin 70. The operating power for trip operation of the circuit breaker 10 is provided by a charged main toggle coil spring 72. The main toggle coil spring 72 is interconnected with a handle yoke 44 by way of a handle yoke attachment post 45. The other end of the spring 72 is attached to the toggle link pin 50. The cradle 52 has a latch 73, which is captured or held in place at an opening 63 of the primary latch 62 when the separable main contacts 28 and 30 are closed. No tripping of the circuit breaker 10 can take place by way of the operating mechanism 22 until the primary latch 62 has been actuated away from the cradle latch 73 in a manner which will be described below.

There is provided a combination secondary latch-primary latch torsion spring (not shown) disposed on a spring pin 79. The torsion spring exerts suitable force against both of the latches 62,68 to bias them in the on position of FIG. 3. Actuation of the primary latch 62 and the secondary latch 68 occurs, first, by way of the utilization of a resetable trip unit trip plunger 74, which is normally contained entirely within the removable trip unit 24. The trip unit trip plunger 74 is controlled or latched by way of a plunger latch or interference latch 75 of the trip unit 24. The secondary latch 68 is in disposition to be struck by the moving trip unit plunger abutment surface 80.

Although the primary and secondary latches 62,68 are disposed within a housing 11 formed by the base 12 and the covers 14,16, the trip unit plunger 74 is responsible for initiating all tripping action from the trip unit 24 into the region of the secondary latch 68. The secondary latch 68 is actuated to rotate clockwise with respect to FIG. 3, for example, in direction 81 about its pivot 70.

As the secondary latch 68 pivots, a stop surface of the secondary latch 68 rotates away from the top of the primary latch 62. At this point, the force of the main spring 72 overcomes the force of the torsion spring (not shown), thereby causing the primary latch 62 to rotate clockwise (with respect to FIG. 3) under the force of the cradle 52 and its latch 73. This causes the primary latch opening 63 to clear the cradle latch 73, in order to allow the cradle 52 to rotate counterclockwise (with respect to FIG. 3) about its pivot 54 under the power of the now collapsing main spring 72 by way of the force exerted thereupon by the upper toggle link 46 acting against the cradle to upper toggle link pivot pin 58. As the main spring 72 relaxes, the upper and lower toggle links collapse, which, in turn, causes the movable contact arm main pivot assembly 59 to rotate clockwise (with respect to FIG. 3) about its pivot 60. This causes the contact arm 32 to rotate similarly in the same direction, thereby opening the separable main contacts 28,30 and, in most cases, establishing an electrical arc of conducting electrical current there across. Upon opening of the separable main contacts 28,30, the electrical arc is exposed to an arc chute 77.

Figure 4:
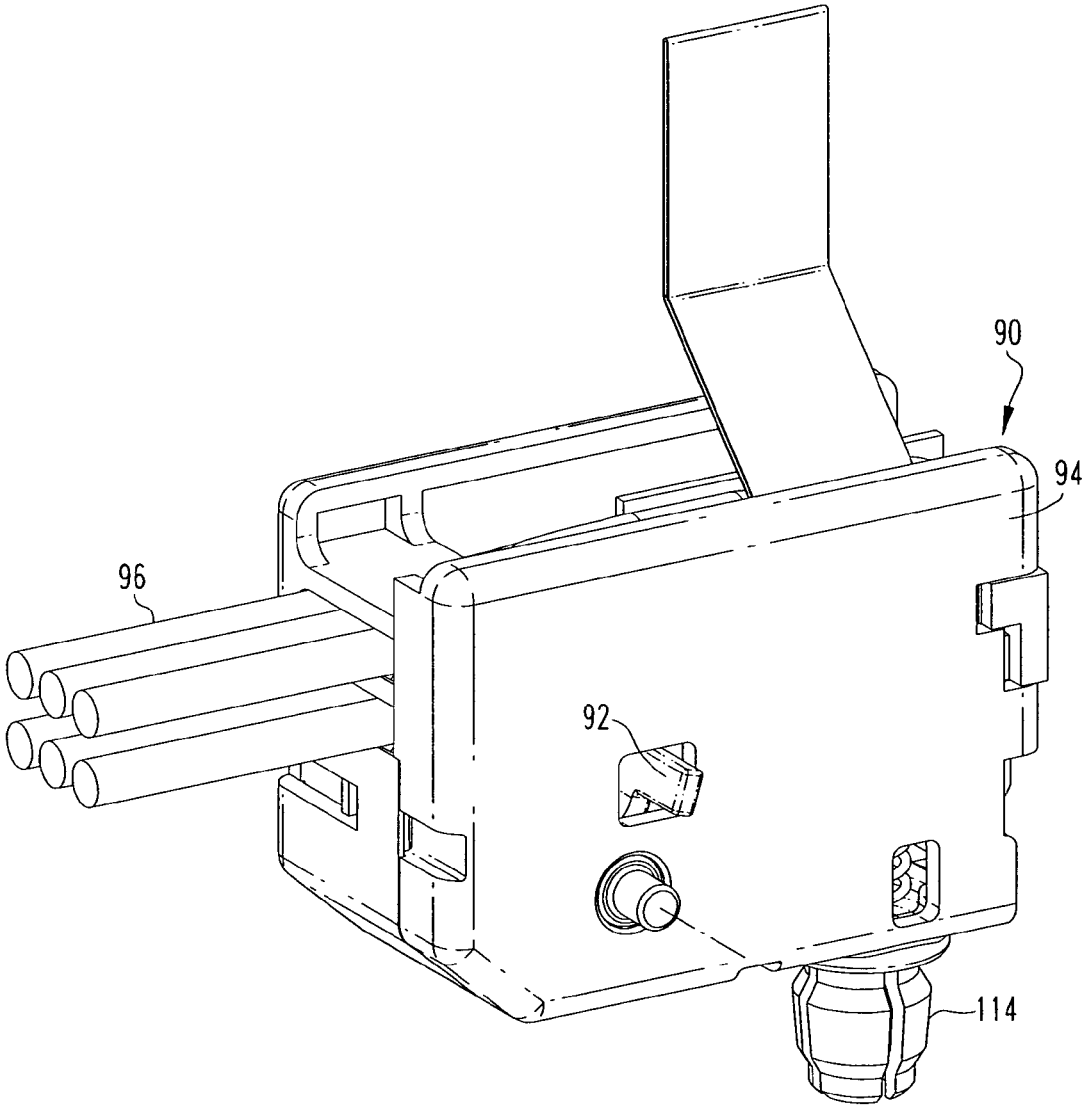
FIG. 4 is an isometric view of an alarm switch forming a part of the circuit breaker of FIG. 1.

According to an aspect of the present invention, circuit breaker 10 is provided with alarm switch 90 shown in FIG. 4. Alarm switch 90 includes actuation lever 92 in the form of a plastic part or other suitable material that protrudes outwardly from the switch housing 94. Movement of the actuation lever 92, in a manner described below, causes the actuation lever 92 to activate a micro-switch (not shown) within housing 94. Activation of the micro-switch actuates the electrical contacts 96 of the switch 90 that operate an alarm device, such as a warning bell or light, that is connected therewith to indicate that circuit breaker 10 has moved to a tripped position.

Figure 5:
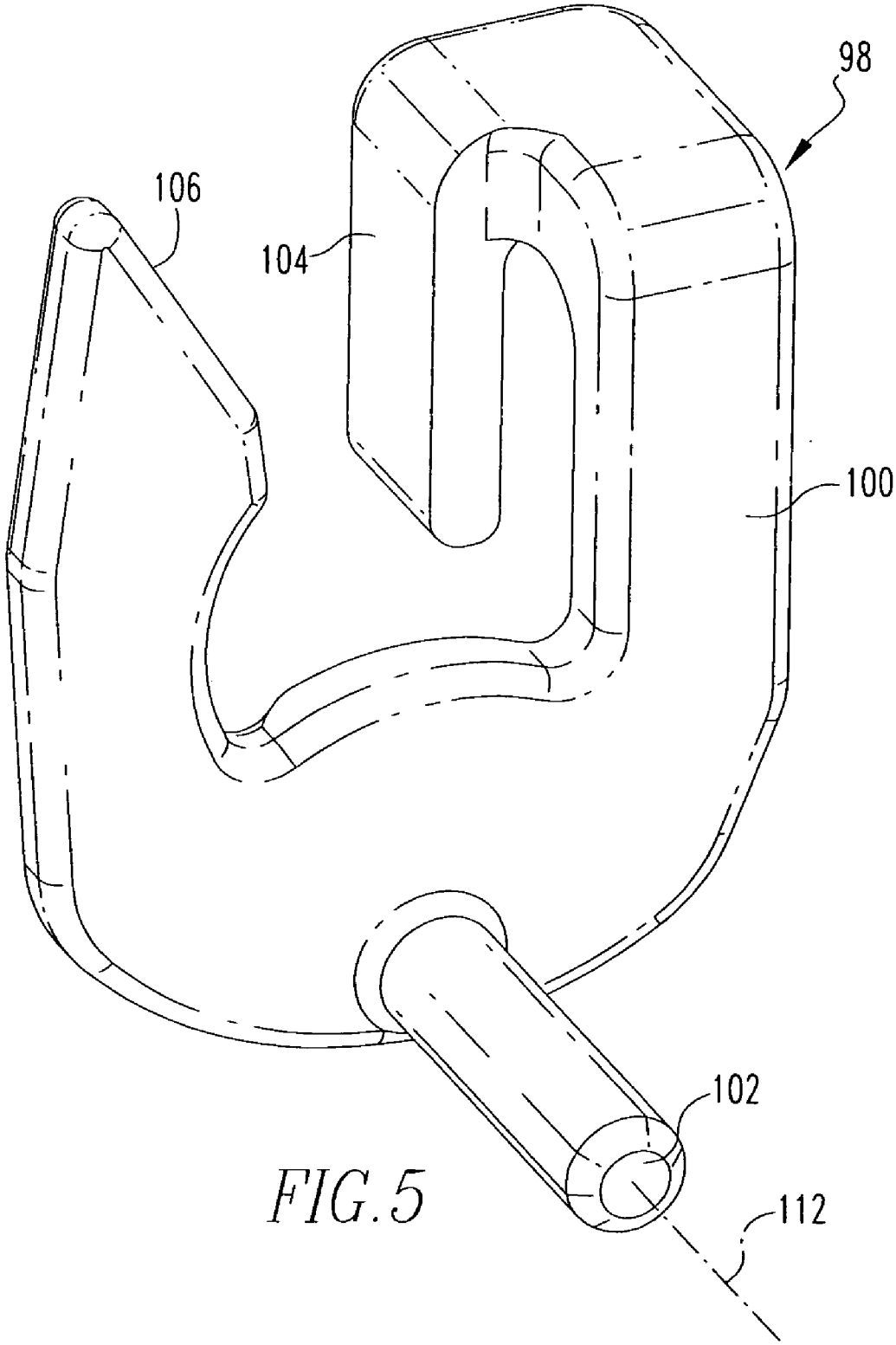
FIG. 5 is an isometric view of an interface lever forming a part of the circuit breaker of FIG. 1.
Figure 6:
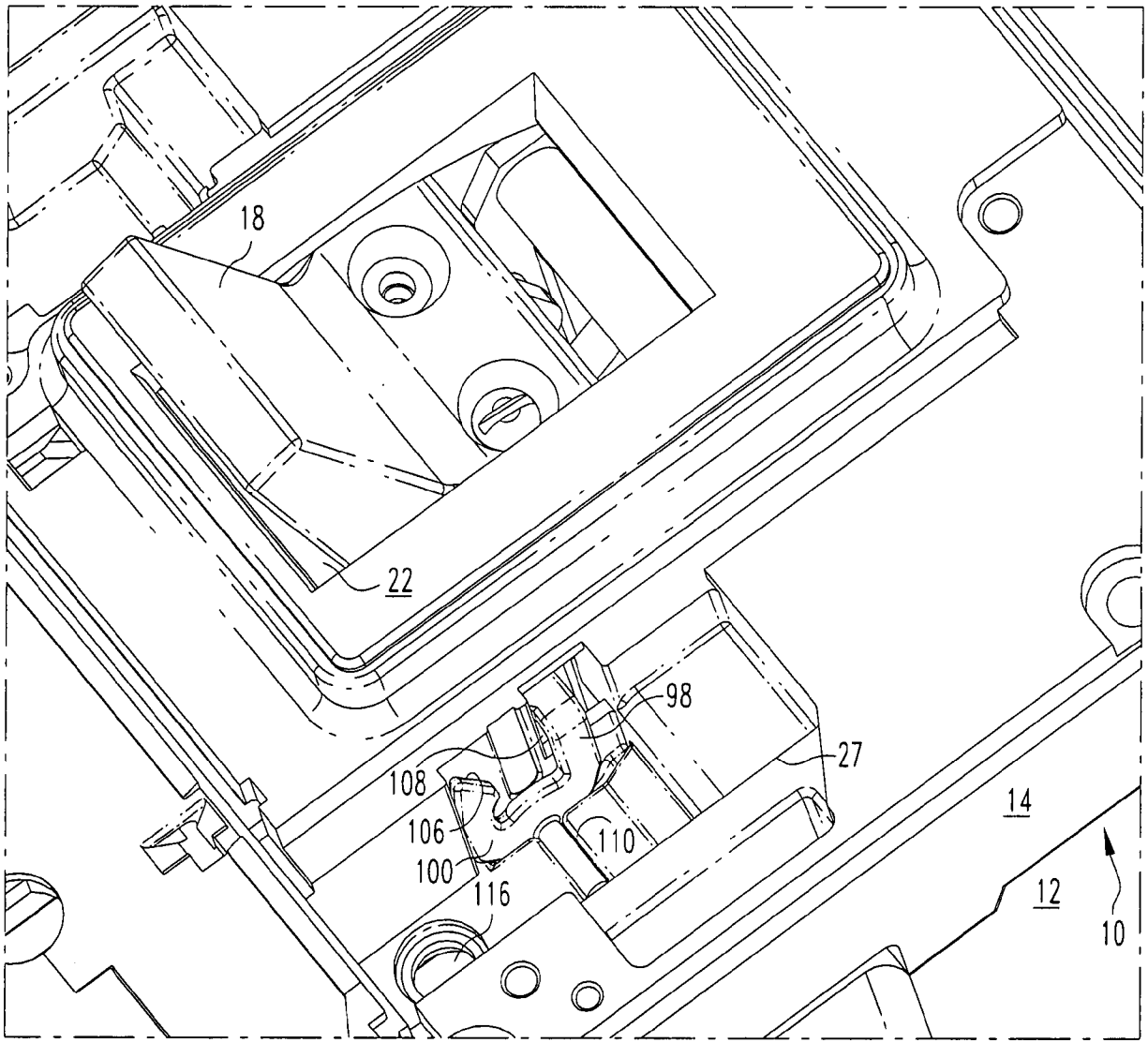
FIG. 6 is a partial isometric view of the circuit breaker of FIG. 1 with a secondary cover removed showing the interface lever of FIG. 5 inserted therein.
Figure 7:
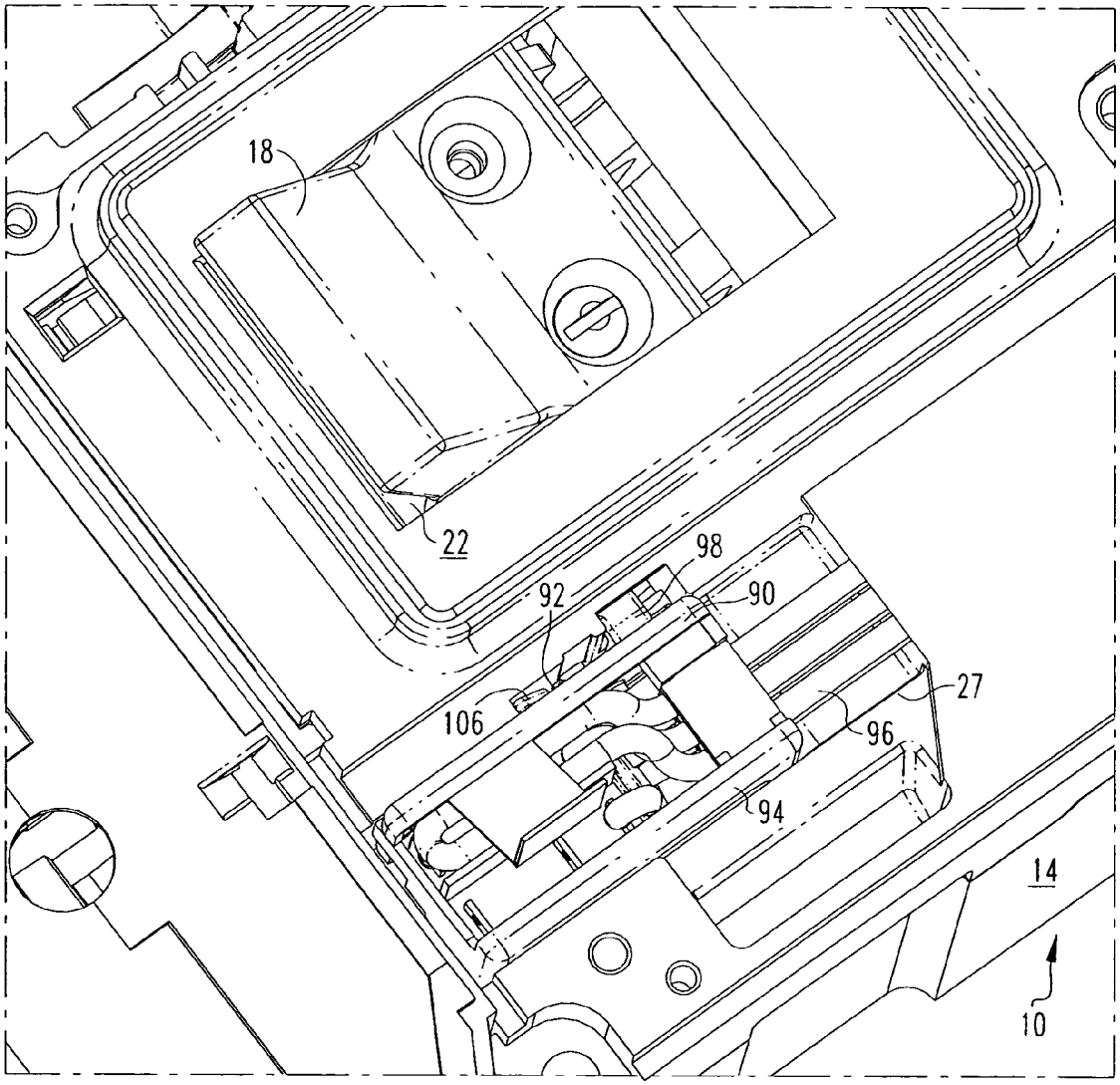
FIG. 7 is a partial isometric view of the circuit breaker of FIG. 1 with a secondary cover removed showing the interface lever of FIG. 5 and the alarm switch of FIG. 4 inserted therein.

Circuit breaker 10 is also provided with interface lever 98 shown in FIG. 5 which, in combination with cradle 52 as described in greater detail below, actuates the actuation lever 92 of alarm switch 90. Interface lever 98 includes generally U-shaped body 100, pin 102, cradle interface surface 104 and alarm actuation surface 106. Interface lever 98 is inserted into circuit breaker 10 as shown in FIG. 6. In particular, interface lever 98 is inserted into right side accessory region or pocket 27 (FIG. 2). As seen in FIG. 6, right side accessory region or pocket 27 is provided with aperture 108 through which cradle interface surface 104 of interface lever 98 is inserted and recess 110 for receiving pin 102 of interface lever 98. In such a configuration, interface lever 98 is free to rotate about the central axis 112 thereof (FIG. 5) while seated in right side accessory region or pocket 27. The significance of this rotation is described below. After interface lever 98 is seated within right side accessory region or pocket 27, alarm switch 90 is inserted into right side accessory region or pocket 27 in the manner shown in FIG. 7. To facilitate such insertion, pin 114 of alarm switch 90 is inserted into aperture 116 provided in right side accessory region or pocket 27.

Figure 8:
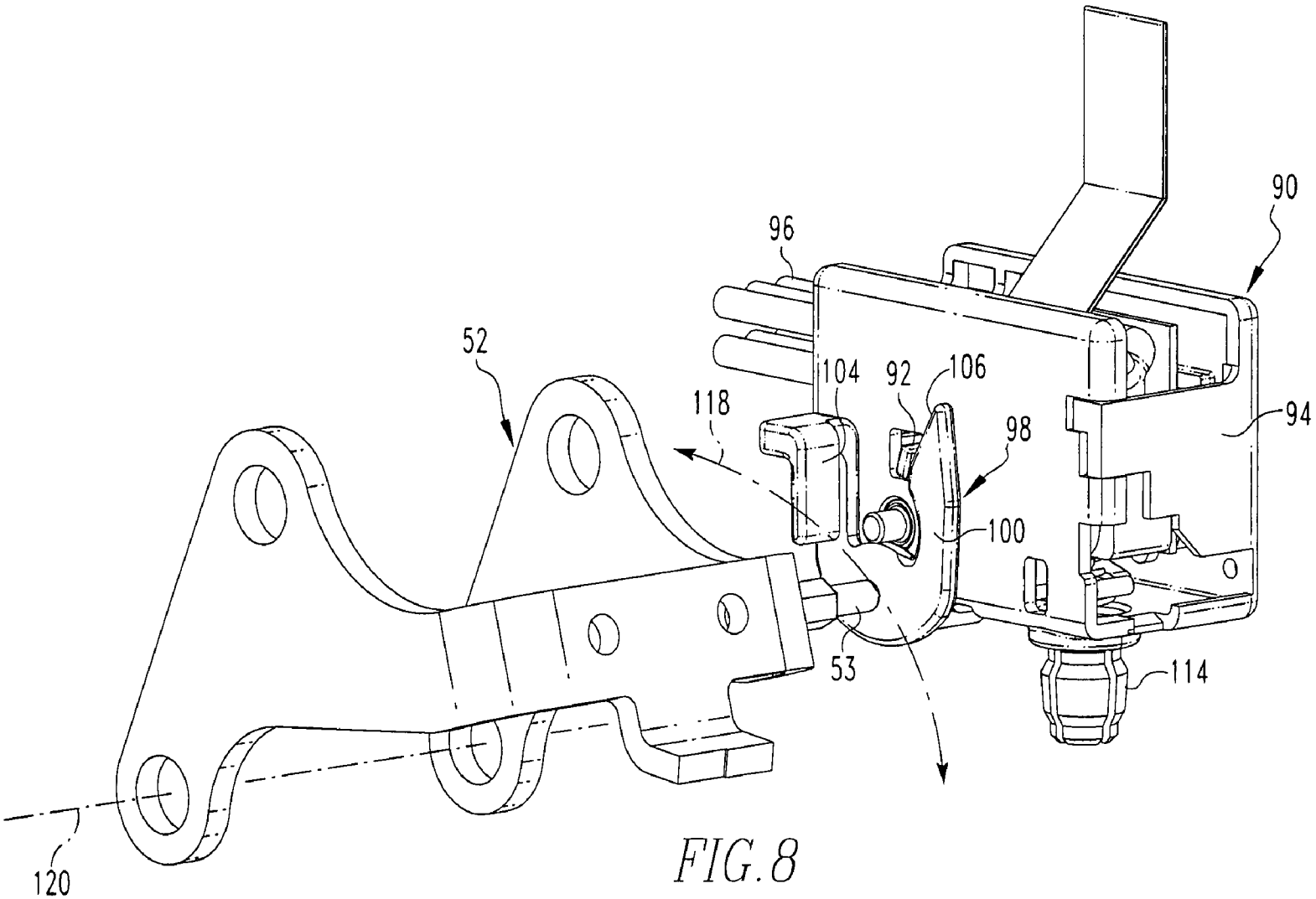
FIG. 8 is an isometric view of the cradle, interface lever and alarm switch as position inside the circuit breaker of FIG. 1 with the other components of the circuit breaker of FIG. 1 removed for clarity.

When alarm switch 90 is inserted into right side accessory region or pocket 27, cradle 52, alarm switch 90, and interface lever 98 are positioned with respect to one another in the manner shown in FIG. 8, which is an isometric view showing cradle 52, alarm switch 90, and interface lever 98 with the other components of circuit breaker 10 removed for clarity purposes. As seen in FIG. 8, this configuration results in alarm actuation surface 106 of interface lever 98 being aligned with and preferably abutting up against actuation lever 92 of alarm switch 90, and in side protrusion 53 of cradle 52 being aligned with cradle interface surface 104 of interface lever 98. As described above, cradle 52 rotates in a counterclockwise manner, as indicated by the arrows 118 in FIG. 8, about axis 120 when circuit breaker 10 is tripped and moves to a tripped position. When the cradle 52 rotates in that manner, side protrusion 53 of cradle 52 engages cradle interface surface 104 of interface lever 98 and causes interface lever 98 to rotate in a counterclockwise manner, as indicated by the arrows 118 in FIG. 8, about axis 112 of the interface lever 98. Such rotation causes alarm actuation surface 106 of interface lever 98 to exert a force against actuation lever 92 of alarm switch 90, which in turn causes the actuation lever 92 to activate a micro-switch (not shown) within housing 94. As described above, activation of the micro-switch actuates the electrical contacts 96 of the switch 90, thereby causing the activation of an alarm device, such as a warning bell or light, that is connected therewith to indicate that circuit breaker 10 has moved to a tripped position. According to one aspect of the invention, cradle interface surface 104 is designed to be flexible so that it will, if necessary, flex to accommodate any over-travel of cradle 52. As will be appreciated, interface lever 98 thus provides a contact interface between cradle 52 and alarm switch 90 for actuating alarm switch 90 in situations where a direct actuation of alarm switch 90 by cradle 52 is not feasible because of the configuration of circuit breaker 10 and the positioning of the various components therein.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A circuit breaker, comprising:

a housing;

separable contacts;

a cradle rotatably mounted within said housing, said cradle adapted to rotate about a first axis in a first direction when said circuit breaker moves to a tripped position in which said separable contacts are separated from one another, said cradle having a protrusion extending therefrom;

an alarm switch mounted within said housing, said alarm switch having an actuation lever movable in an actuation direction, wherein movement of said actuation lever in said actuation direction causes said alarm switch to activate an alarm device electrically connected thereto; and an interface lever disposed between said cradle and said alarm switch;

wherein when said cradle rotates in said first direction, said cradle exerts a first force against said interface lever, said first force causing said interface lever to exert a second force against said actuation lever, said second force causing said actuation lever to move in said actuation direction.

2. The circuit breaker of claim 1, wherein said interface lever is rotatably mounted within said housing, said interface lever having a cradle interface surface aligned with said protrusion and an alarm actuation surface aligned with said actuation lever, said interface lever being adapted to rotate about a second axis in a second direction, wherein when said cradle rotates in said first direction, said protrusion exerts said first force against said cradle interface surface, said first force causing said interface lever to rotate in said second direction, and wherein when said interface lever rotates in said second direction, said alarm actuation surface exerts said second force against said actuation lever.

3. The circuit breaker of claim 2, wherein said interface lever has a generally U-shaped body, said cradle interface surface being located at a first end of said generally U-shaped body and said alarm actuation surface being located at a second end of said generally U-shaped body.

4. The circuit breaker of claim 2, wherein said housing includes an accessory pocket, said interface lever and said alarm switch being mounted within said accessory pocket.

5. The circuit breaker of claim 4, wherein said accessory pocket has a recess, wherein said interface lever has a pin extending therefrom, said pin being received by said recess, and wherein said second axis is a central axis of said pin.

6. The circuit beaker of claim 2, wherein at least a portion of said interface lever that includes said cradle interface surface is flexible to accommodate any over-travel condition of said cradle.

* * * * *